US006681428B2

(12) United States Patent
Wells

(10) Patent No.: US 6,681,428 B2
(45) Date of Patent: Jan. 27, 2004

(54) METHOD OF MAKING POCKETED COIL SPRING UNIT WITH COMBINATION OF SCRIM SHEETS AND INTER-ROW BONDING

(75) Inventor: Thomas J. Wells, Carthage, MO (US)

(73) Assignee: L&P Property Management Co., South Gate, CA (US)

( * ) Notice: Subject to any disclaimer, the term of this patent is extended or adjusted under 35 U.S.C. 154(b) by 21 days.

(21) Appl. No.: 10/107,993

(22) Filed: Mar. 27, 2002

(65) Prior Publication Data

US 2002/0124321 A1 Sep. 12, 2002

Related U.S. Application Data

(62) Division of application No. 09/493,380, filed on Jan. 28, 2000, now Pat. No. 6,374,442.

(51) Int. Cl.[7] ..... A47C 27/06

(52) U.S. Cl. ..... 5/720 ; 5/655.8; 267/91

(58) Field of Search ..... 5/720, 727, 655.8, 5/655.7; 29/91, 91.1, 896.92; 156/301, 332, 320, 324; 200/91

(56) References Cited

U.S. PATENT DOCUMENTS

| | | | |
|---|---|---|---|
| 1,434,653 A | 11/1922 | Fiss et al. | |
| 2,296,807 A | 9/1942 | Cavaler | |
| 2,862,214 A | 12/1958 | Thompson et al. | |
| 3,429,767 A | 2/1969 | Bronstein, Jr. et al. | |
| 3,449,190 A | 6/1969 | Bronstein, Jr., et al. | |
| 4,234,983 A | 11/1980 | Stumpf | |
| 4,401,501 A | 8/1983 | Stumpf | |
| 4,485,506 A | 12/1984 | Stumpf et al. | |
| 4,566,926 A | 1/1986 | Stumpf | |
| 4,578,834 A | 4/1986 | Stumpf | |
| 4,907,309 A | 3/1990 | Breckle | |
| 5,016,304 A | 5/1991 | Ryhiner | |
| 5,016,305 A | 5/1991 | Suenens et al. | |
| 5,126,004 A | 6/1992 | Suenens et al. | |
| 5,273,608 A | 12/1993 | Nath | |
| 5,319,815 A | 6/1994 | Stumpf et al. | |
| 5,637,178 A | 6/1997 | Suenens et al. | |
| 5,670,001 A | 9/1997 | Huebner et al. | |
| 5,746,877 A | 5/1998 | Notheis et al. | |
| 5,851,339 A | 12/1998 | Rucker | |
| 6,098,968 A | 8/2000 | Workman | |
| 6,175,997 B1 | 1/2001 | Mossbeck | 29/91 |
| 6,243,900 B1 | 6/2001 | Gladney et al. | |
| 6,398,199 B1 | 6/2002 | Barber | |
| 2002/0113348 A1 | 8/2002 | Barber | |

FOREIGN PATENT DOCUMENTS

| | | |
|---|---|---|
| DE | 4031652 | 4/1992 |
| DE | 4040220 | 6/1992 |
| EP | 0089789 | 9/1983 |
| EP | 0357912 | 3/1990 |
| FR | 1475098 | 2/1967 |
| FR | 2076465 | 10/1971 |
| FR | 2470088 | 5/1981 |
| GB | 743678 | 6/1920 |

*Primary Examiner*—Matthew C. Graham
(74) *Attorney, Agent, or Firm*—Wood, Herron & Evans, LLP

(57) ABSTRACT

A pocketed coil spring unit and associated method of assembly combines top and bottom sheets with bonding of the sidewalls of adjacent rows of pocketed coil springs. With this combination, a posturized spring unit is produced in a commercially efficient manufacturing process. The top and bottom sheets extend perpendicularly to the rows of pocketed coil springs and the adjacent rows of pocketed coil springs are bonded on the sidewalls of the fabric pockets in the absence of the top and bottom sheets. As such, the spring unit can be customized for posturization to provide a firmer supporting foundation at the locations of the top and bottom sheets and a more individualized flexible construction in the regions of the inter-row sidewall bonding.

20 Claims, 2 Drawing Sheets

METHOD OF MAKING POCKETED COIL SPRING UNIT WITH COMBINATION OF SCRIM SHEETS AND INTER-ROW BONDING

This is a divisional of U.S. patent application Ser. No. 09/493,380, filed Jan. 28, 2000 and issued as U.S. Pat. No. 6,374,442 on Apr. 23, 2002.

BACKGROUND OF THE INVENTION

This invention relates generally to spring units for use in mattresses, spring upholstered furniture and the like and, more particularly, to an improved pocketed coil spring unit and associated method of manufacturing such a spring unit.

A well known type of spring assembly includes a number of discrete coil springs, each of which is enclosed in a fabric pocket in a length of folded fabric material. Longitudinal axes of the coil springs are generally parallel with one another so that the top and bottom end turns of the coil springs define top and bottom faces of the spring unit. A spring assembly can be fabricated from such a spring unit by forming rows of the pocketed coil springs and binding or adhering the individual rows together to form a mattress or spring assembly.

This type of spring assembly is commonly referred to as a pocketed spring unit due to the fact that each spring is contained within an individual pocket of fabric material. The construction of strings of pocketed coil springs in each pocket is well known in the art and, for example, disclosed in U.S. Pat. No. 4,439,977 which is hereby incorporated by reference in its entirety. The system disclosed in that patent includes a spring coiler which forms a coil spring which is subsequently compressed and inserted between the plies of folded pocketing fabric material. Other systems for manufacturing pocketed coil spring assemblies are disclosed in PCT Patent Application No. WO94/18116 and U.S. patent application Ser. No. 08/927,051 filed Sep. 10, 1997, each of which are expressly incorporated herein by reference.

Pocketed spring units are generally recognized to have a unique and particular luxurious feel to them and mattresses manufactured of such pocketed spring units provide a feeling of softness without lacking spring resilience or support. Mattresses and similar articles constructed of pocketed spring units are often considered a high-end type of product because of the added benefits and features of the pocketed coil springs. Mattresses and the like of this type can be more costly to manufacture and assemble as a result of the considerable amount of time and labor which is involved in their manufacture, together with the fact that the method of fabrication and assembly of such pocketed spring units can be complicated, particularly in an automated process.

One particular aspect of the commercial production of pocketed spring units and the associated mattresses or the like is the handling of such units in the factories. The manipulation and movement of the various components of the spring unit from station to station or various areas of the factories can be cumbersome, difficult and inconvenient depending on the particular production facilities and assembly techniques.

Additionally, while pocketed spring units are considered to provide a combination of softness and support, the ability to economically posturize a spring unit or mattress of pocketed spring coils has heretofore been unavailable. Posturization provides zones of support within a mattress. For example, the middle regions of the mattress, which typically support a person's torso, often require a firmer more resilient support while other areas of the mattress which support the feet and head of a person require a softer feel.

Therefore, there is a need for an improved pocketed spring unit and associated method of manufacture which offers the advantages of posturization of the spring unit without the higher manufacturing costs, production difficulties and inefficiencies associated with known spring units.

SUMMARY OF THE INVENTION

These and other objectives of the invention have been obtained in an improved pocketed coil spring unit and associated method of manufacturing such a spring unit according to this invention. In one embodiment, the pocketed coil spring unit of this invention and associated method combines top and bottom sheets with side gluing or bonding of the rows of pocketed coil springs. By using this combination, a posturized spring unit is produced in a commercially effective manufacturing process.

The pocketed coil spring unit includes narrow strips of non-woven material extending generally perpendicular to the rows of pocketed coil springs. Supply rolls of the non-woven sheets are positioned on the top and bottom of the coil unit being assembled. Strings or rows of pocketed coil springs are serially added to the forming coil unit which is positioned between top and bottom conveyors. Adhesive is applied to the top and bottom sheets to adhere the sheets to the top or bottom surface of the pocketed coil springs as the rows are added to the forming coil spring unit. The strips of top and bottom sheets are positioned as required on the coil spring unit and, in one embodiment, just one sheet in the center of the spring unit on the top and bottom faces is utilized to provide posturization of the spring unit, mattress or the like. The top and bottom sheets are applied to the top and bottom, respectively, of the coil spring unit at locations where a firmer, more resilient support foundation is desired. On the remaining sections of the coil spring unit, side gluing or bonding of the adjacent rows or strings of pocketed coil springs is utilized to provide the flexible benefits of such a construction. Specifically, in one embodiment, the sidewalls of the pocketed coil springs are sprayed with adhesive or otherwise bonded to the sidewalls of pocketed coil spring units in adjacent rows. Known spring units which are side glued or bonded to the adjacent rows of coil spring units typically do not have the top and bottom sheets bonded thereto.

One advantage of this invention is the ability to efficiently and conveniently handle the coil spring unit in the factories in that it will act like a top/bottom glued construction while still providing the flexible benefits of a side glued unit. Moreover, this invention offers the ability to customize or posturize the spring unit with various zones of resiliency and support. As such, this invention provides increased benefits during the manufacturing of pocketed coil spring units while offering advantages, including posturization, not currently available in known pocketed coil spring units, mattresses or the like.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
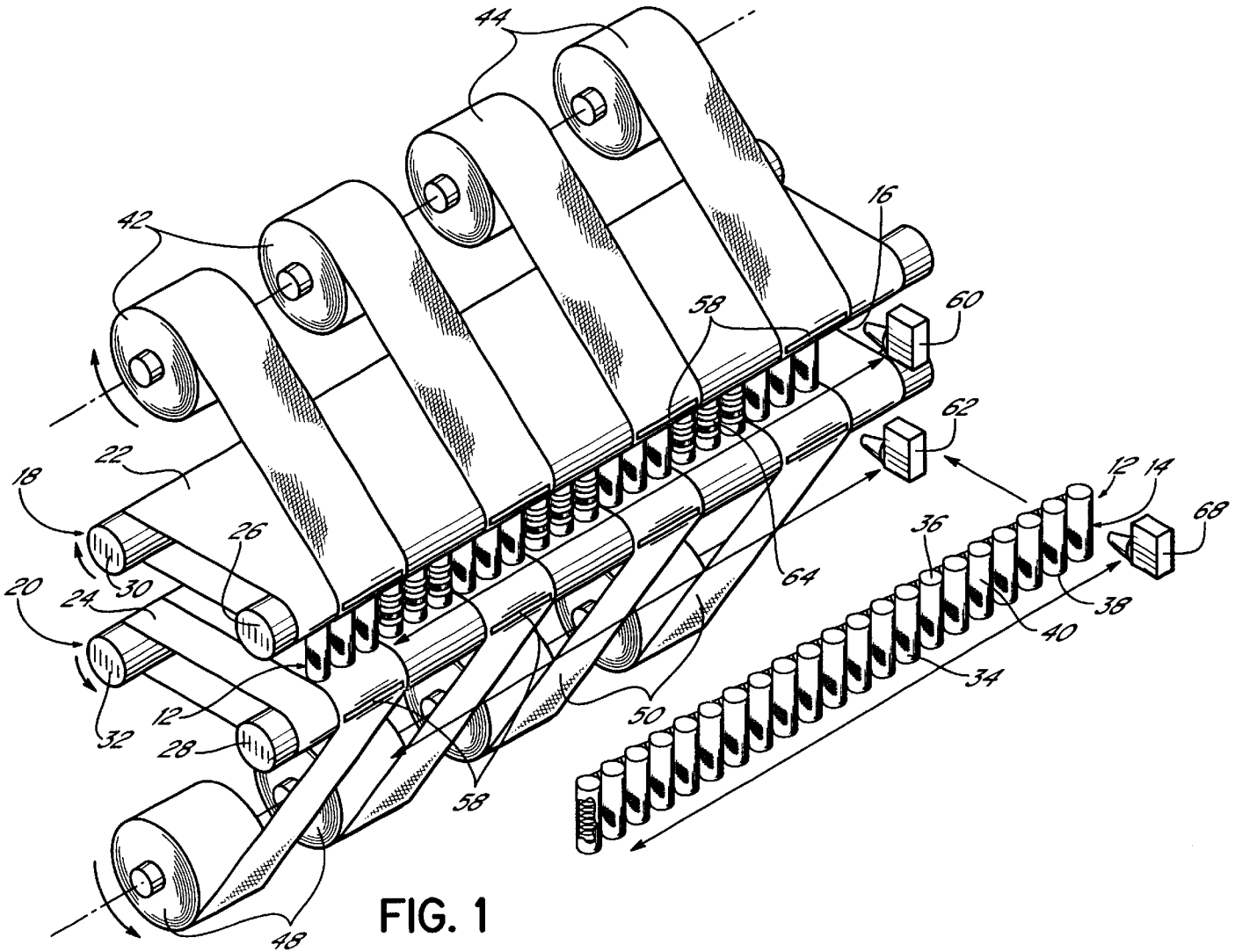
FIG. 1 is a perspective view of a pocketed spring unit being assembled between top and bottom conveyors according to one embodiment of this invention.
Figure 2:
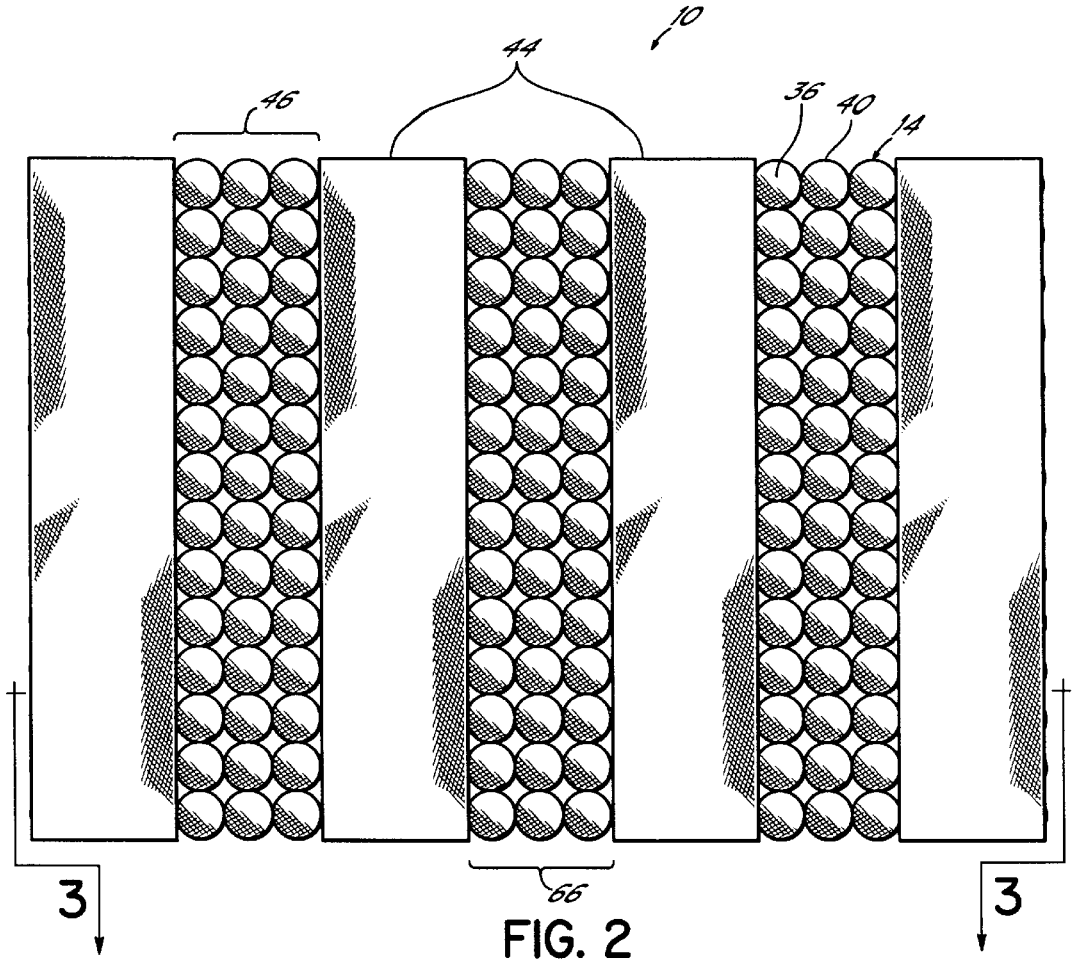
FIG. 2 is a top plan view of a spring unit according to one embodiment of this invention.
Figure 3:
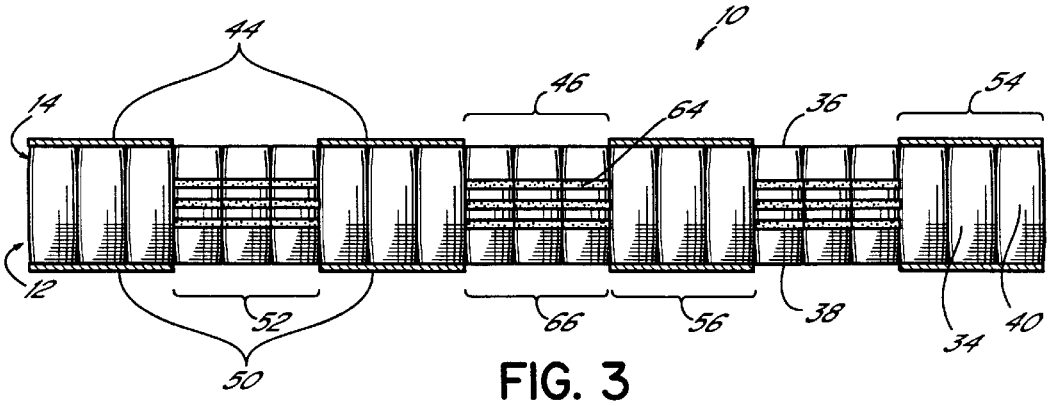
FIG. 3 is a cross-sectional view taken along line 3—3 of the spring unit of FIG. 2.

Referring to FIG. 1, one embodiment of a system and method for manufacturing a pocketed coil spring unit 10 (as shown in FIGS. 2 and 3) is shown. Particularly, individual rows 12 of pocketed coil springs 14 are serially introduced into the gap 16 between an upper conveyor 18 and a lower conveyor 20. Each of the conveyors 18, 20 includes a belt 22, 24 trained around a forward roller 26, 28 and a trailing roller 30, 32, at least one of which is rotationally driven for movement of the belt 22, 24 as shown in FIG. 1.

Each row 12 of pocketed coil springs includes a number of coil springs 14 encased in a fabric pocket 34 having a top end 36, a bottom end 38 and a sidewall 40 extending between the top and bottom ends 36, 38 of each pocket 34. Commonly, each row 12 of pocketed coil springs 14 is manufactured as a continuous string as is well known in the art. An example of the manufacture of a string of pocketed coil springs is disclosed in U.S. Pat. No. 4,439,977. The fabric in one embodiment of this invention is a nonwoven material which is thermally or ultrasonically weldable to itself as is well known in the art.

A number of supply rolls 42, four of which are shown in FIG. 1, feed preferably nonwoven material, similar to that used to encase the coil springs 14, as top sheets 44 on the top of the spring unit 10. Each of the top sheets 44 are separated from the adjacent top sheet by a spacing 46. Similarly, a number of supply rolls 48 are located below the lower conveyor 20 to feed nonwoven or other sheet material as bottom sheets 50 located on the bottom of the spring unit 10. The bottom sheets 50 are also each separated by a spacing 52 from the adjacent bottom sheet 50. Although four top sheets 44 and four bottom sheets 50 are shown in FIG. 1, it should be readily understood that any number of top and bottom sheets can be used within the scope of this invention. The top and bottom sheets 44, 50 extend generally perpendicular to the rows 12 of pocketed coil springs 14 and, in one embodiment, the top and bottom sheets 44, 50 are aligned generally vertically with respect to each other.

The top sheets 44 are each bonded to the top ends 36 of each of a first set 54 of pocketed coil springs 14. Similarly, the bottom sheets 50 are each bonded to the bottom ends 38 of each of a second set 56 of pocketed coil springs 14. In the embodiment shown in the Figures, the coil springs 14 of the first set 54 and second set 56 are the same springs.

The top and bottom sheets 44, 50 are each bonded to the respective top and bottom ends 36, 38 of the fabric pockets 34 of the coil springs 14 by an adhesive 58 which has been sprayed onto the top and bottom sheets 44, 50 from respective upper and lower adhesive applicators 60, 62, as shown in FIG. 1. However, it should be readily understood that the term "bonding" as used herein applies to other means of attachment for the sheets 44, 50 to the rows 12 of pocketed coil springs 14, such as thermally activated adhesive embedded in the sheets and/or the fabric pockets, stitching, mechanical fasteners such as lacing wire, clips, clamps or other techniques.

Adhesive 64 is also applied to the sidewall 40 of the fabric pockets 34 of a third set 66 of pocketed coil springs 14 from an adhesive applicator 68. In the embodiment shown in FIG. 1, the fabric pockets 34 of the coil springs 14 to which the adhesive 64 is applied on the sidewalls 40 are those coil springs which do not have the top or bottom sheets 44, 50 bonded thereto. As a result, the posturization of the resulting spring unit 10 is achieved through differing performance characteristics of the sections of the spring unit 10 to which the top and bottom sheets 44, 50 are bonded relative to the sections which have inter-row bonding. In the embodiment shown in FIG. 1, the adhesive 64 is sprayed onto the sidewalls 40 of the appropriate fabric pockets 66 prior to the row 12 being introduced between the upper and lower conveyors 18, 20. Once again, although an adhesive spray applicator 68 is shown, other techniques, as previously mentioned, for bonding the sidewall 40 of the fabric pockets 34 of selected pocketed coil springs in the adjacent rows can be utilized within the scope of this invention.

Referring to FIGS. 2 and 3, the resulting spring unit 10 is shown in which the top and bottom sheets 44, 50 are bonded to the top and bottom ends 36, 38, respectively, of the fabric pockets 34 of specific pocketed coil springs 54, 56. In the embodiment shown in FIGS. 2 and 3, four top and four bottom sheets 44, 50 are utilized and each of the top and bottom sheets 44, 50 are separated a spacing 46, 52 of three pocketed coil springs 14 from the adjacent sheet. This arrangement is used for illustration purposes only and other spacings 46, 52 can be utilized as desired within the scope of this invention. Additionally, the springs 66 positioned in the spacings 46, 52 between the respective top and bottom sheets have the adhesive 64 applied to the sidewalls 40 of the fabric pockets 34 for bonding of the adjacent rows 12 together. The adhesive pattern on the sidewalls 40 of those fabric pockets 34 may be straight lines extending across multiple fabric pockets 14 or another pattern that is appropriate for the desired spring unit 10.

As a result, a pocketed spring unit 10 is easily and efficiently manufactured in a commercial production manner which performs like a top/bottom glued spring unit construction for easier handling in the factories while still offering the flexible benefits, including posturization, of a side glued spring unit.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A method of making a spring unit comprising the steps of:

arranging a plurality of rows of pocketed coil springs, each row including a plurality of coil springs each encased in a fabric pocket, each fabric pocket having a top end, a bottom end and a sidewall between the top and bottom ends, the sidewalls of the fabric pockets of each row of pocketed coil springs being juxtaposed to the sidewalls of the fabric pockets of an adjacent row with the top and bottom ends of the fabric pockets combining to define top and bottom surfaces, respectively, of the spring unit;

bonding a plurality of top sheets to the top ends of the fabric pockets of selected pocketed coil springs, each of the top sheets being generally perpendicular to the rows of pocketed coil springs and separated by a spacing from an adjacent top sheet;

bonding a plurality of bottom sheets to the bottom ends of the fabric pockets of the selected pocketed coil springs, each of the bottom sheets being generally perpendicular to the rows of pocketed coil springs and aligned with one of the top sheets;

bonding the sidewalls of the fabric pockets of the pocketed coil springs in the spacings between adjacent top sheets to the sidewalls of the fabric pockets of pocketed coil springs in an adjacent row to provide differing performance characteristics to the pocketed coil springs located in the spacings relative to the selected pocketed coil springs.

2. The method of claim 1, wherein the bonding of the top sheets, the bottom sheets and the sidewalls is accomplished by an adhesive spray applicator.

3. The method of claim 1 further comprising:

serially inserting each of the rows of pocketed coil springs between spaced upper and lower conveyors;

feeding the top and bottom sheets from respective supply rolls between the top ends and the upper conveyor and the bottom ends and the lower conveyor, respectively;

spraying adhesive onto the top and bottom sheets for bonding to the respective top and bottom ends of the selected pocketed coil springs; and spraying adhesive onto the sidewalls of the pocketed coil springs in the spacings between the top sheets.

4. A method of making a spring unit comprising the steps of:

arranging at least one string of interconnected pocketed coil springs into a plurality of rows, each row including a plurality of coil springs each encased in a fabric pocket, each fabric pocket having a opposed ends and a sidewall between the opposed ends, the sidewalls of the fabric pockets of each row of pocketed coil springs being juxtaposed to the sidewalls of the fabric pockets of an adjacent row with the corresponding ends of the fabric Dockets combining to define opposed surfaces;

bonding at least one sheet to the corresponding ends of the fabric pockets of selected pocketed coil springs on a first one of the opposed surfaces; and bonding the sidewalls of at least some of the fabric pockets of the pocketed coil springs to the sidewalls of the fabric pockets of pocketed coil springs in an adjacent row;

wherein the at least one sheet is bonded to less than all of the pocketed coil springs of the spring unit to provide differing performance characteristics for the spring unit relative to those pocketed coil springs that do not have the sheet bonded thereto.

5. A method of making a spring unit comprising the steps of:

arranging at least one string of interconnected pocketed coil springs into a plurality of rows, each row including a plurality of coil springs each encased in a fabric pocket, each fabric pocket having a opposed ends and a sidewall between the opposed ends, the sidewalls of the fabric pockets of each row of pocketed coil springs being juxtaposed to the sidewalls of the fabric pockets of an adjacent row with the corresponding ends of the fabric pockets combining to define opposed surfaces;

bonding at least one sheet to the corresponding ends of the fabric pockets of selected pocketed coil springs on a first one of the opposed surfaces;

bonding the sidewalls of at least some of the fabric pockets of the pocketed coil springs to the sidewalls of the fabric pockets of pocketed coil springs in an adjacent row; and bonding at least one sheet to the corresponding ends of the fabric pockets of selected pocketed coil springs on a second one of the opposed surfaces;

wherein a plurality of sheets are bonded to each of the first and second opposed surfaces and each of the sheets is spaced from an adjacent sheet on the corresponding surface.

6. A method of making a spring unit comprising the steps of:

arranging a plurality of rows of pocketed coil springs, each row including a plurality of coil springs each encased in a fabric pocket, each fabric pocket having a opposed ends and a sidewall between the opposed ends, the sidewalls of the fabric pockets of each row of pocketed coil springs being juxtaposed to the sidewalls of the fabric pockets of an adjacent row with the corresponding ends of the fabric pockets combining to define opposed surfaces;

bonding at least one sheet to the corresponding ends of the fabric pockets of selected pocketed coil springs on a first one of the opposed surfaces; and bonding the sidewalls of at least some of the fabric pockets of the pocketed coil springs to the sidewalls of the fabric pockets of pocketed coil springs in an adjacent row;

wherein the at least one sheet is bonded to less than all of the pocketed coil springs of the spring unit to provide differing performance characteristics for the spring unit relative to those pocketed coil springs that do not have the sheet bonded thereto.

7. A method of making a spring unit comprising the steps of:

arranging a plurality of rows of pocketed coil springs, each row including a plurality of coil springs each encased in a fabric pocket, each fabric pocket having a opposed ends and a sidewall between the opposed ends, the sidewalls of the fabric pockets of each row of pocketed coil springs being juxtaposed to the sidewalls of the fabric pockets of an adjacent row with the corresponding ends of the fabric pockets combining to define opposed surfaces;

bonding at least one sheet to the corresponding ends of the fabric pockets of selected pocketed coil springs on a first one of the opposed surfaces;

bonding the sidewalls of at least some of the fabric pockets of the pocketed coil springs to the sidewalls of the fabric pockets of pocketed coil springs in an adjacent row; and bonding at least one sheet to the corresponding ends of the fabric pockets of selected pocketed coil springs on a second one of the opposed surfaces;

wherein a plurality of sheets are bonded to each of the first and second opposed surfaces and each of the sheets is spaced from an adjacent sheet on the corresponding surface.

8. A method of making a spring unit comprising the steps of:

arranging a plurality of rows of pocketed coil springs, each row including a plurality of coil springs each encased in a fabric pocket, each fabric pocket having a top end, a bottom end and a sidewall between the top and bottom ends, the sidewalls of the fabric pockets of each row of pocketed coil springs being juxtaposed to the sidewalls of the fabric pockets of an adjacent row with the top and bottom ends of the fabric pockets combining to define top and bottom surfaces, respectively, of the spring unit;

bonding a top sheet to the top ends of the fabric pockets of a first set of pocketed coil springs;

bonding a bottom sheet to the bottom ends of the fabric pockets of a second set of pocketed coil springs;

bonding the sidewalls of the fabric pockets of a third set of pocketed coil springs to the sidewalls of the fabric pockets of pocketed coil springs in an adjacent row.

9. The method of claim 8 further comprising:

orienting the top and bottom sheets generally perpendicular to the rows of pocketed coil springs.

10. The method of claim 8 further comprising:

bonding a plurality of top sheets to the top ends of the first set of pocketed coil springs;

spacing each of the top sheets from an adjacent top sheet;

bonding a plurality of bottom sheets to the bottom ends of the second set of pocketed coil springs; and spacing each of the bottom sheets from an adjacent bottom sheet.

11. The method of claim 8 wherein the first and second sets of pocketed coil springs are identical so that the top and bottom sheets are aligned and bonded to the same coil springs.

12. The method of claim 8 wherein the top and bottom ends of the third set of pocketed coil springs are not bonded to the top and bottom sheets, respectively.

13. The method of claim 8 wherein the bonding of the top sheet, the bottom sheet and the sidewalls is accomplished by an adhesive spray applicator.

14. The method of claim 8 further comprising:

serially inserting each of the rows of pocketed coil springs between spaced upper and lower conveyors;

feeding the top and bottom sheets from respective supply rolls between the top ends and the upper conveyor and the bottom ends and the lower conveyor, respectively;

spraying adhesive onto the top and bottom sheets for bonding to the respective top and bottom ends of the first and second sets of pocketed coil springs; and spraying adhesive onto the sidewalls of the third set of pocketed coil springs.

15. A method of making a spring unit comprising the steps of:

arranging at least one string of interconnected pocketed coil springs into a plurality of rows, each row including a plurality of coil springs each encased in a fabric pocket, each fabric pocket having a opposed ends and a sidewall between the opposed ends, the sidewalls of the fabric pockets of each row of pocketed coil springs being juxtaposed to the sidewalls of the fabric pockets of an adjacent row with the corresponding ends of the fabric pockets combining to define opposed surfaces;

bonding at least one sheet to the corresponding ends of the fabric pockets of selected pocketed coil springs on a first one of the opposed surfaces; and bonding the sidewalls of at least some of the fabric pockets of the pocketed coil springs directly to the sidewalls of the fabric pockets of pocketed coil springs in an adjacent row.

16. The method of wherein the bonding of the at least one sheet and the bonding of the sidewalls are accomplished in combination with one another.

17. The method of claim 15 wherein the bonding of the at least one sheet and the bonding of the sidewalls are accomplished concurrently.

18. The method of claim 15 further comprising:

bonding at least one sheet to the corresponding ends of the fabric pockets of selected pocketed coil springs on a second one of the opposed surfaces.

19. The method of claim 18 wherein the sheets bonded to the first and second opposed surfaces are generally aligned with one another and are bonded to the same pocketed coil springs.

20. The method of claim 15 further comprising:

orienting the at least one sheet generally perpendicular to the rows of pocketed coil springs.

* * * * *

UNITED STATES PATENT AND TRADEMARK OFFICE

CERTIFICATE OF CORRECTION

PATENT NO. : 6,681,428 B2
DATED : January 27, 2004
INVENTOR(S) : Thomas J. Wells It is certified that error appears in the above-identified patent and that said Letters Patent is hereby corrected as shown below:

Column 4,
Line 20, "each of the top and bottom sheets 44, 50 are" should read -- each of the top and bottom sheets 44, 50 is --.

Signed and Sealed this

Eighteenth Day of May, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,681,428 B2
DATED : January 27, 2004
INVENTOR(S) : Thomas J. Wells It is certified that error appears in the above-identified patent and that said Letters Patent is hereby corrected as shown below:

Column 4,
Line 20, “each of which are” should read -- each of which is --.

Column 5,
Line 33, “Dockets” should read -- pockets --.

Column 8,
Line 20, “The method of wherein” should read -- The method of claim 15 wherein --.

Signed and Sealed this

Third Day of August, 2004

JON W. DUDAS
*Acting Director of the United States Patent and Trademark Office*